US007681652B2

(12) United States Patent
Gaudette et al.

(10) Patent No.: US 7,681,652 B2
(45) Date of Patent: Mar. 23, 2010

(54) PACKER SETTING DEVICE FOR HIGH-HYDROSTATIC APPLICATIONS

(75) Inventors: Sean L. Gaudette, Katy, TX (US); James C. Doane, Friendswood, TX (US); Robert S. O'Brien, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 134 days.

(21) Appl. No.: 11/729,675

(22) Filed: Mar. 29, 2007

(65) Prior Publication Data

US 2008/0236844 A1 Oct. 2, 2008

(51) Int. Cl.
*E21B 33/128* (2006.01)
*E21B 23/06* (2006.01)

(52) U.S. Cl. ..... 166/387; 166/187; 166/196

(58) Field of Classification Search ..... 166/381, 166/387, 187, 196
See application file for complete search history.

(56) References Cited

U.S. PATENT DOCUMENTS 3,139,140 A 6/1964 Brown ..... 166/120
3,716,101 A * 2/1973 McGowen et al. ..... 166/60
5,419,394 A * 5/1995 Jones ..... 166/51
6,843,315 B2 1/2005 Coronado ..... 166/196
6,978,842 B2 * 12/2005 Read et al. ..... 166/383
2007/0056745 A1 3/2007 Contant ..... 166/382
2007/0193733 A1 8/2007 Basmajian et al. ..... 166/66.6

OTHER PUBLICATIONS

Armenta et al., "Applications of Mechanical External Casing Packers," SPE 105380 (Mar. 11-14, 2007).
King, James G., "A Comparison of Interventionless Packer Setting Techniques and Enhanced Functionality Considerations," SPE 77774 (2002).
King et al., "A Methodology for Selecting Interventionless Packer Setting Techniques," SPE 90678 (2004).

* cited by examiner

*Primary Examiner*—Giovanna C Wright
(74) *Attorney, Agent, or Firm*—Shawn Hunter

(57) ABSTRACT

A packer setting device provides a buffered setting mechanism as a substantially incompressible fluid is selectively flowed into a compressible fluid chamber to compress a compressible fluid. This fluid transfer causes movement of a setting sleeve so that an associated packer device is set within a wellbore.

19 Claims, 8 Drawing Sheets

PACKER SETTING DEVICE FOR HIGH-HYDROSTATIC APPLICATIONS

BACKGROUND OF THE INVENTION

1. Field of the Invention

The invention relates generally to packer setting devices. In particular aspects, the invention relates to the design of devices for setting packers using hydrostatic wellbore fluid pressure.

2. Description of the Related Art

Packers are used to create a seal within the annulus of a wellbore between an interior tubular string and the wall of the wellbore. Packers incorporate an elastomeric sealing element that can be radially expanded to set the packer. The packer may also incorporate one or more metallic slip elements that create a mechanical anchorage between the interior tubular string and the wellbore. Commonly, packers are mechanically set by applying an axial force to the sealing element and slip elements to cause them to be expanded radially outwardly and into engagement with the surrounding wellbore wall. A setting tool can be used to do this. Alternatively, fluid can be pumped down the flowbore of the interior tubular string and the fluid pressure used to axially compress the packer element.

Another method of setting the packer device is by use of hydrostatic pressure. U.S. Pat. No. 6,843,315 issued to Coronado et al., for example, describes a hydrostatically-set packer device having a composite sealing element with large radial expansion capabilities for use in through tubing and open hole applications. This patent is owned by the assignee of the present invention and is, therefore, incorporated by reference. The hydrostatic pressure of the column of fluid within the wellbore is used to provide the setting force for compressing the packer element. However, there are difficulties with the design of setting devices that are used in very deep wells due to the presence of high hydrostatic pressures. In particular, hydrostatic pressures of 20,000 psi or greater are problematic. With such ambient pressures, the setting mechanism can be prone to premature actuation and setting of an associated packer. In addition, certain components of setting devices, such as large volume chambers, are prone to crushing damage at great depths.

The present invention addresses the problems of the prior art.

SUMMARY OF THE INVENTION

The invention provides devices and methods for actuating a downhole tool, such as a packer, using hydrostatic pressure as an actuating force. In a preferred embodiment, a packer setting device is used that includes a compressible fluid chamber. In one described embodiment, the compressible fluid chamber preferably includes a plurality of small-diameter hydrostatic chambers that are filled with a compressible fluid at a relatively low or atmospheric pressure. In another embodiment, the compressible fluid chamber comprises a helically coiled tube. In addition, the setting device includes an incompressible fluid chamber that is filled with a volume of substantially incompressible fluid and initially separated from the compressible fluid chamber by a trigger device.

In operation, the packer setting device provides a buffered setting mechanism as the substantially incompressible fluid is selectively flowed into the compressible fluid chamber to compress the compressible fluid. This fluid transfer causes movement of the setting sleeve so that the associated packer device is set within the wellbore. The substantially incompressible fluid is preferably metered into the compressible fluid chamber along a tortuous, fluid-restrictive flow path to limit the rate of flow of fluid thereby preventing an undesired rapid setting.

In one embodiment the trigger mechanism is a frangible rupture disc that is destroyed by increasing hydrostatic pressure within the wellbore annulus. In another embodiment, the trigger device is a valve that is actuated from the surface.

DETAILED DESCRIPTION OF THE PREFERRED EMBODIMENTS

Figure 1:
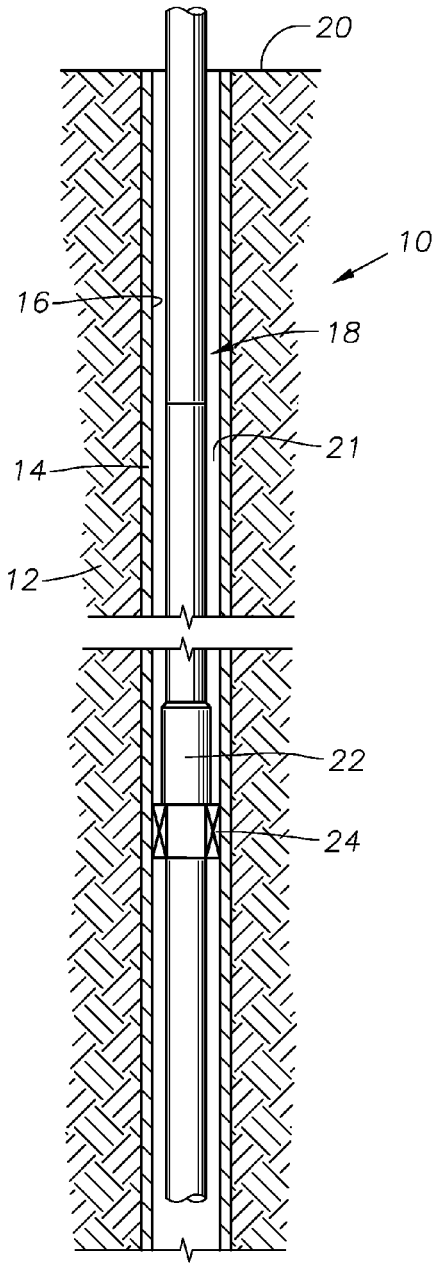
FIG. 1 presents a side, cross-sectional view of an exemplary wellbore having a production string with a packer and packer setting device constructed in accordance with the present invention.

FIG. 1 illustrates an exemplary wellbore 10 that has been drilled through the earth 12 and lined with casing 14 to define an axial flowbore 16 along its length. The flowbore 16 contains a hydrocarbon production string 18 that extends downward therethrough from the surface 20. Those of skill in the art will understand that the production string 18 is suspended within the wellbore 10 by a wellhead (not depicted). An annulus 21 is defined between the production string 18 and the casing 14.

The production string 18 includes a packer setting device 22 that is constructed in accordance with the present invention. A mechanically-set packer device 24 is affixed to the packer setting device 22. The packer device 24 is moveable between set and unset positions, as is known in the art, by the application of axial force in order to force slips and/or seals radially outwardly from the packer device 24 and into engagement with the flowbore 16 of the wellbore 10.

Figure 2:
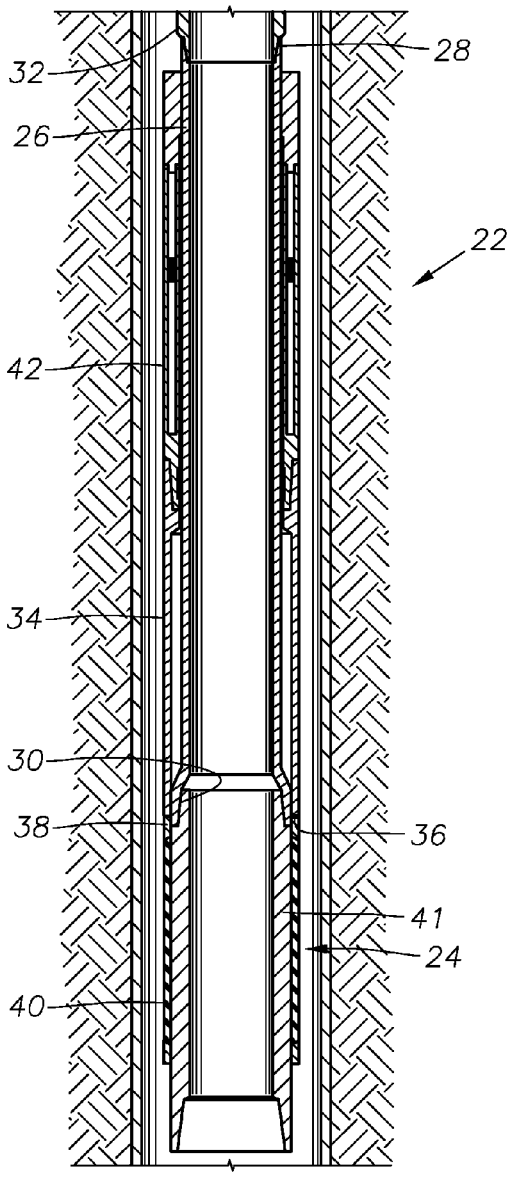
FIG. 2 is a side cross-sectional view of the packer setting device and associated packer in an unactuated condition within a wellbore.

FIG. 2 illustrates the interconnection of the packer setting device 22 to the packer device 24. Generally, the packer setting device 22 includes a central internal mandrel 26 having upper and lower threaded ends 28, 30. The upper threaded end 28 is interconnected to a top sub 32 which, in turn, is interconnected with the production string 18 above the packer device 24 while the lower threaded end 30 is secured to a central body sub 32 of the packer device 24. The packer setting device 22 also includes a setting sleeve 34 that radially surrounds the internal mandrel 26 and is axially moveable with respect thereto. The setting sleeve 34 presents a lower end 36 that abuts a compression setting ring 38 on the packer device 24. Axial movement of the setting ring 38 upon inner sub 41 will set a packer element 40 on the packer device 24.

Figure 3:
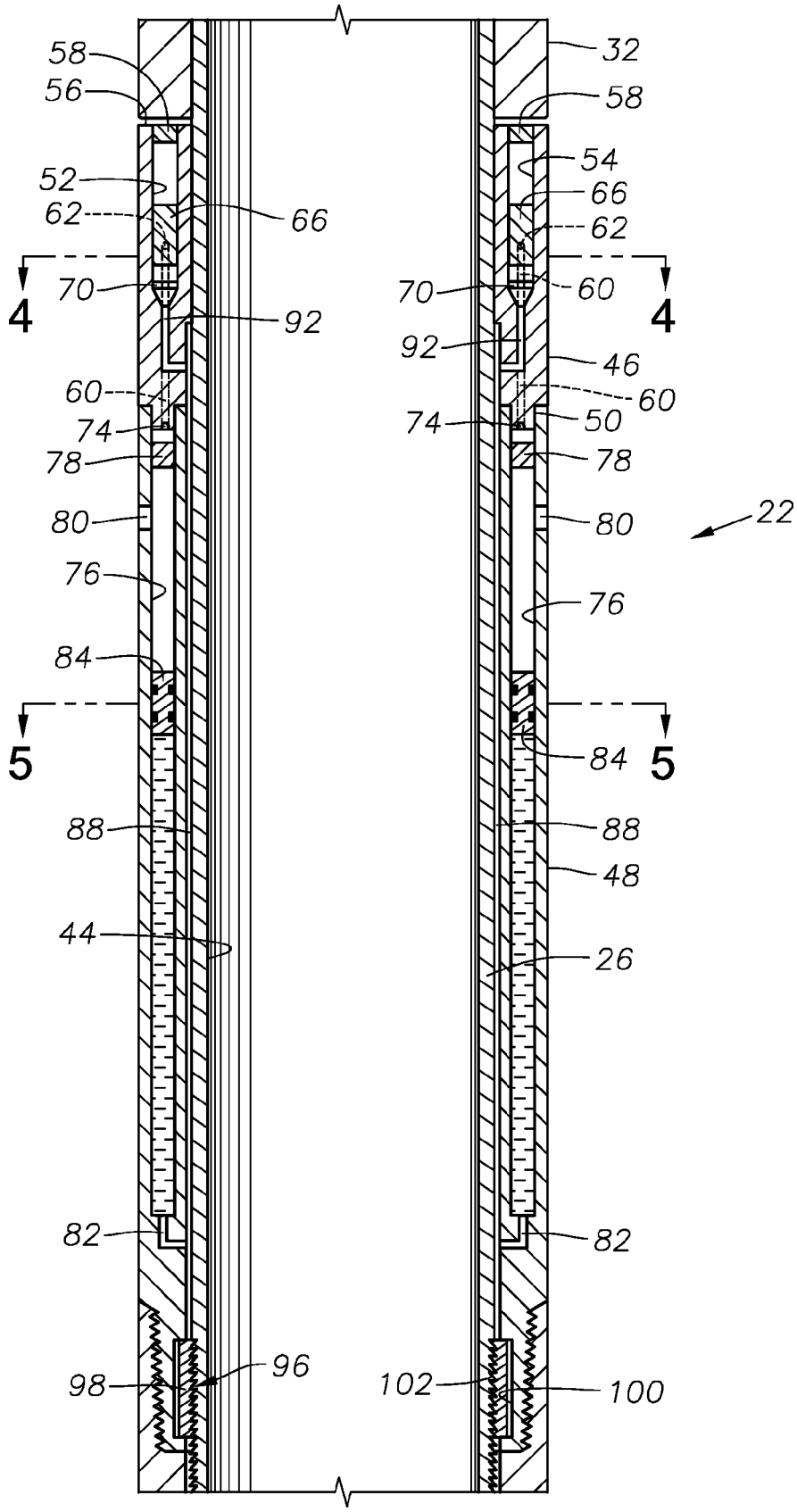
FIG. 3 is an enlarged side cross-sectional view of upper portions of the packer setting assembly shown in FIGS. 1 and 2 in an unactuated position.
Figure 3A:
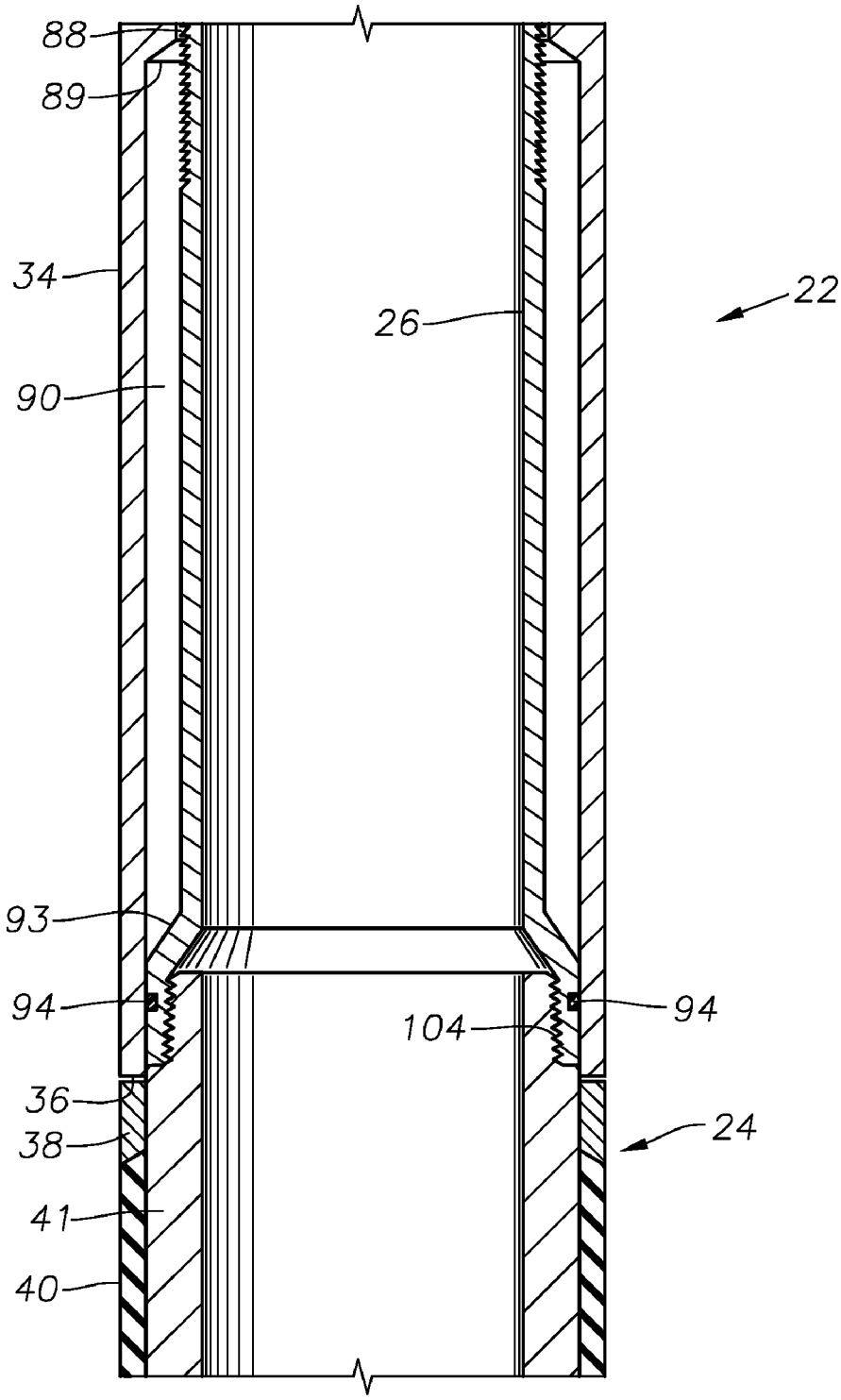
FIG. 3A is an enlarged side cross-sectional view of lower portions of the packer setting assembly shown in FIGS. 1 and 2 in an unactuated condition.
Figure 4:
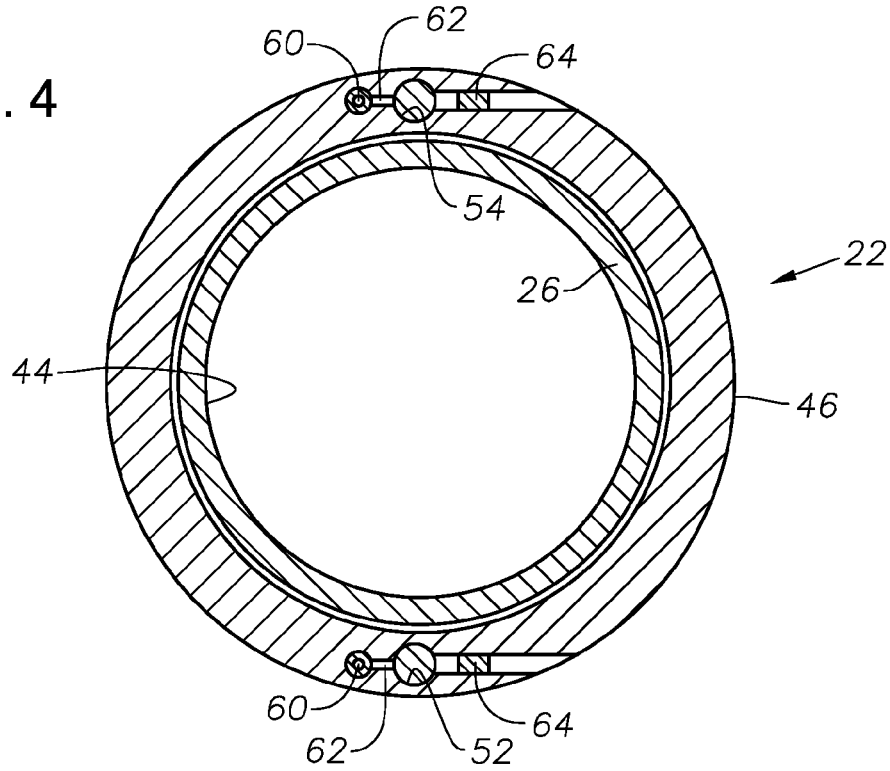
FIG. 4 is an axial cross-sectional view taken along lines 4-4 in FIG. 3.

FIGS. 3, 3A, 4, 5, 6, and 6A illustrate further details of the packer setting device 22 in greater detail. As can be seen from FIG. 3, the interior mandrel 26 of the packer setting device 22 defines an interior flowbore 44. Upper and lower outer housings 46, 48 radially surround the inner mandrel 26. The upper and lower outer housings 46, 48 are affixed to each other via threaded connection 50. The upper housing 46 contains a pair of axial bores 52, 54 that are located on diametrically opposite sides of the housing 46. The bores 52, 54 are preferably created by drilling from the upper axial end 56 of the upper housing 46. The upper end of each chamber 52, 54 is sealed with a pipe plug 58. As can be seen with further reference to FIG. 4, each axial chamber 52, 54 is interconnected with an axial fluid pathway 60 by a lateral flow passage 62. The lateral flow passage 62 may be created by drilling laterally inwardly and then closing the outer portion of the drilled passage with a plug 64, as depicted in FIG. 4. A flow plug 66 is moveably disposed within each bore 52 and 54, and during run-in, prior to actuation, each flow plug 66 blocks its respective lateral passage 62, as shown in FIG. 3. A trigger mechanism 70 is disposed in each bore 52, 54 below the flow plug 66 and blocks the passage of fluid through the bore. In a currently preferred embodiment, the trigger mechanism is a frangible rupture disc, of a type known in the art, which is designed to block the passage of fluid flow through the bore 52 or 54 and which is designed to fail and rupture in response to a sufficiently high predetermined fluid pressure differential within the bore 52, 54. In an alternate embodiment, the trigger mechanism 70 comprises an electronically actuated valve, also of a type known in the art that initially blocks fluid flow through the bore 52 or 54 and can be opened from the surface 20 to permit fluid flow through the bore 52 or 54. The axial fluid pathway 60 extends downwardly through the upper outer housing 46 to an annular channel 74 that is defined between the upper and lower outer housings 46, 48. The use of two (or more) bores 52, 54 and, therefore, two separate trigger devices 70 is currently preferred in order to allow for redundancy.

Figure 5:
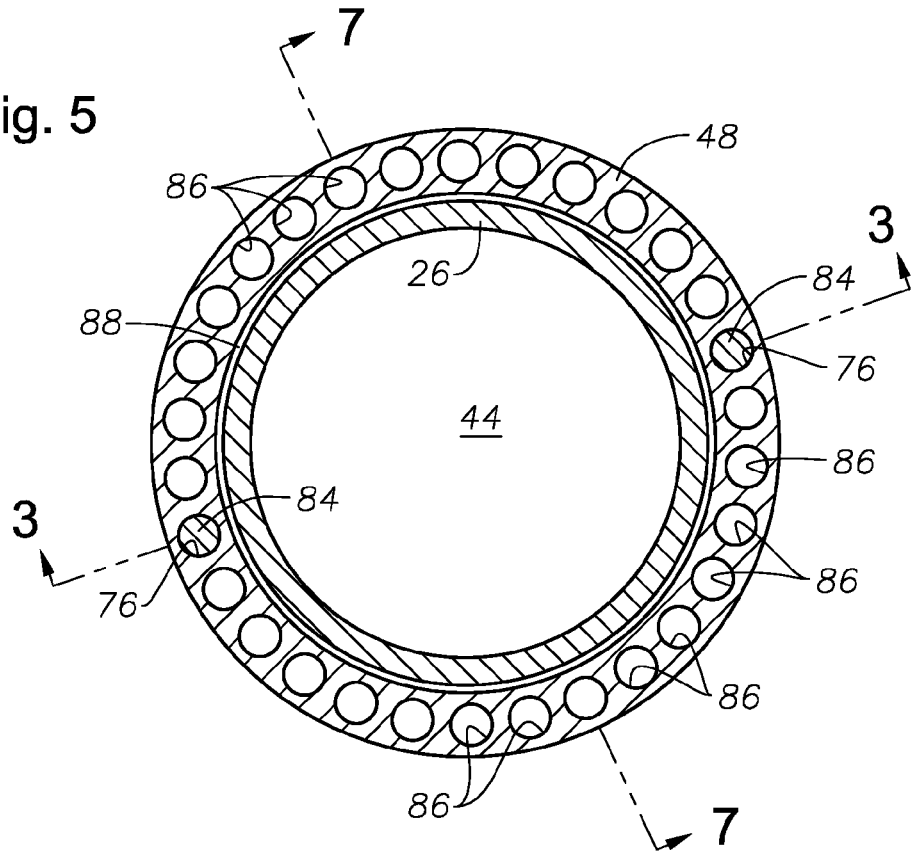
FIG. 5 is an axial cross-sectional view taken along lines 5-5 in FIG. 3.
Figure 7:
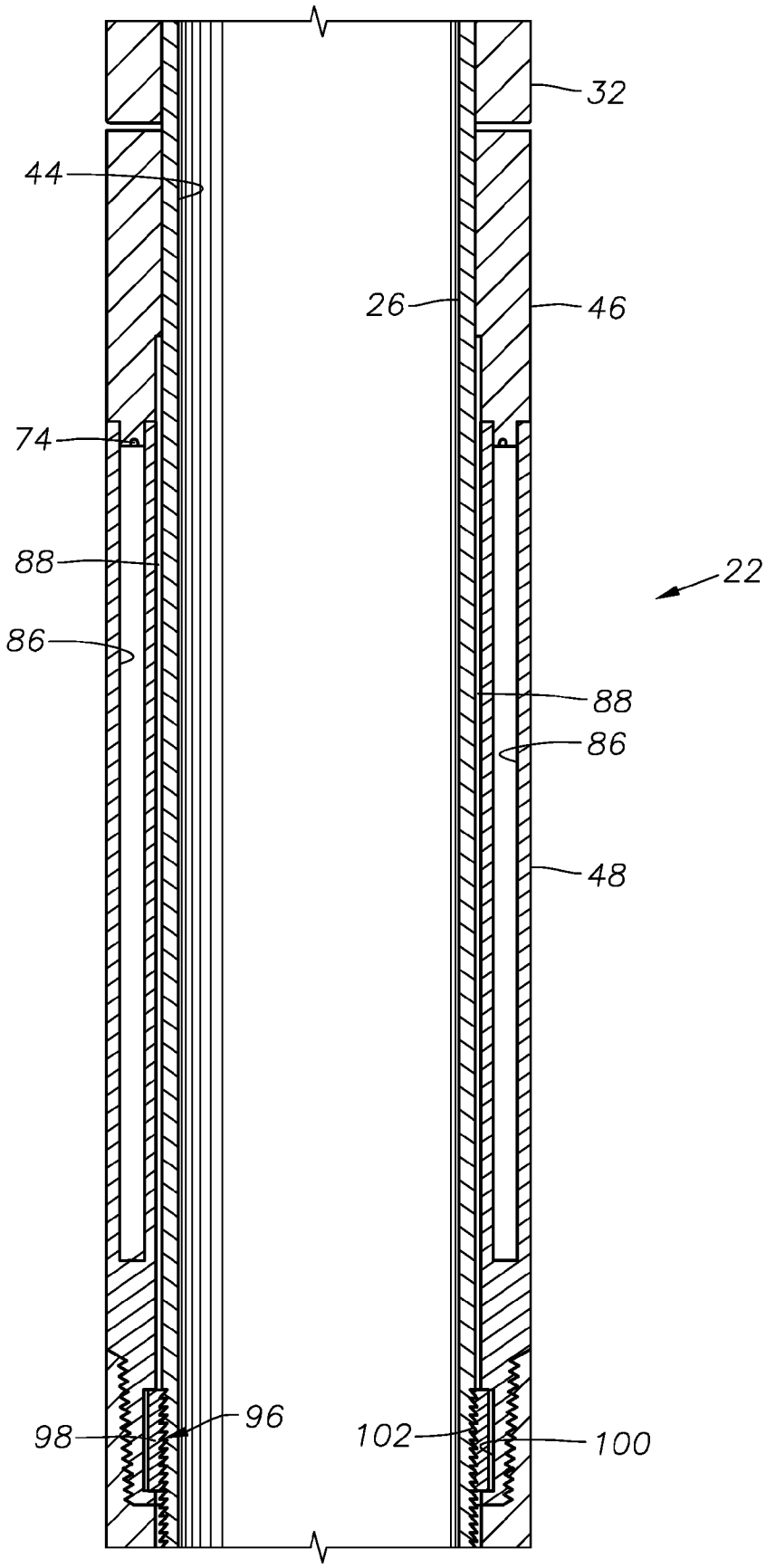
FIG. 7 is an axial cross-section of upper portions of the packer setting assembly taken along lines 7-7 in FIG. 5.

The structure of the lower outer housing 48 is best understood by reference to FIGS. 3, 5 and 7. FIG. 5 is an axial cross-section of the housing 48 and indicates by lines 3-3 and 5-5 how the side cross-sectional views of FIGS. 3 and 5 are taken. FIGS. 3 and 5 illustrate that there are two hydrostatic piston chambers 76 defined within the body of the lower outer housing 48. Each of the piston chambers 76 is blocked from fluid communication with the annular channel 74 at its upper end by a plug 78. However, an opening 80 is provided that allows fluid communication between each piston chamber 76 and the annulus 21 surrounding the setting device 22. In addition, the lower end of each piston chamber 76 has a fluid outlet 82. A piston 84 is moveably disposed within each piston chamber 76.

FIG. 7 shows a different side cross-section of the lower outer housing 48 that is taken along lines 7-7 in FIG. 5. As illustrated a plurality of axial repository blind bores 86 are formed in the body of the housing 48 and disposed in a spaced relation about the circumference of the housing 48. The blind bores 86 are in fluid communication at their upper ends with the annular channel 74. It is currently preferred that, prior to run-in, the blind bores 86 be filled with air at atmospheric pressure. It is noted that during run-in and prior to actuation, the repository blind bores 86 remain at atmospheric pressure due to the presence of the trigger devices 70, which initially isolate the bores 86 from wellbore hydrostatic pressure.

A narrow annular chamber 88 is defined between the interior mandrel 26 and the upper and lower outer housings 46, 48 and setting sleeve 34. The lower end of the chamber 88, visible in FIG. 3A, adjoins a fluid drain chamber 90 that is formed between the setting sleeve 34 and the interior mandrel 26. Fluid pathways 92 place the upper end of annular chamber 88 in fluid communication with both bores 52, 54. In addition, fluid outlets 82 of the piston chambers 76 are in fluid communication with the annular chamber 88. The lower end of the larger chamber 90 is enclosed by outwardly-projecting flange 93 and sealed by fluid seal 94. The upper end of the chamber 90 has a shoulder 89 that projects inwardly from the setting sleeve 34. The chambers 90 and 88 are, prior to run-in, filled with a substantially incompressible fluid. It is currently preferred that, prior to run-in, a hydraulic fluid, such as a viscous oil, be used to fill the chambers 90 and 88. This incompressible fluid will also be present within the fluid outlets 82 and piston chambers 76 below the pistons 84. In addition, the incompressible fluid will be present within the fluid pathways 92 and the lower ends of bores 52 and 54, below the trigger devices 70. It is noted that pistons 84 are in communication with both the wellbore fluid and the substantially incompressible fluid.

Referring now to FIG. 3, a body lock ring assembly 96, of a type known in the 20 art, is provided to ensure one way, ratchet-type motion of the outer housings 46, 48 and the affixed setting sleeve 34 with respect to the central mandrel 26. The body lock ring assembly 96 includes a C-ring member 98 that is disposed within a recess 100 between the lower outer housing 48 and the inner mandrel 26. The radial interior surface 102 of the ring member 98 is corrugated with one-way teeth in a manner known in the art so as to ensure that the housings 46, 48 and setting sleeve 34 move axially downwardly with respect to the interior mandrel 26, but not axially upwardly. Fluid within the annular chamber 88 will be able to bleed past the body lock ring assembly 96 because the assembly 96 is not fluid tight and contains at least one break in continuity to form C-ring member 98. The lower end of the interior mandrel 26 of the packer setting device 22 is affixed by threaded connection 104 to the inner sub 41 of the packer device 24.

Figure 6:
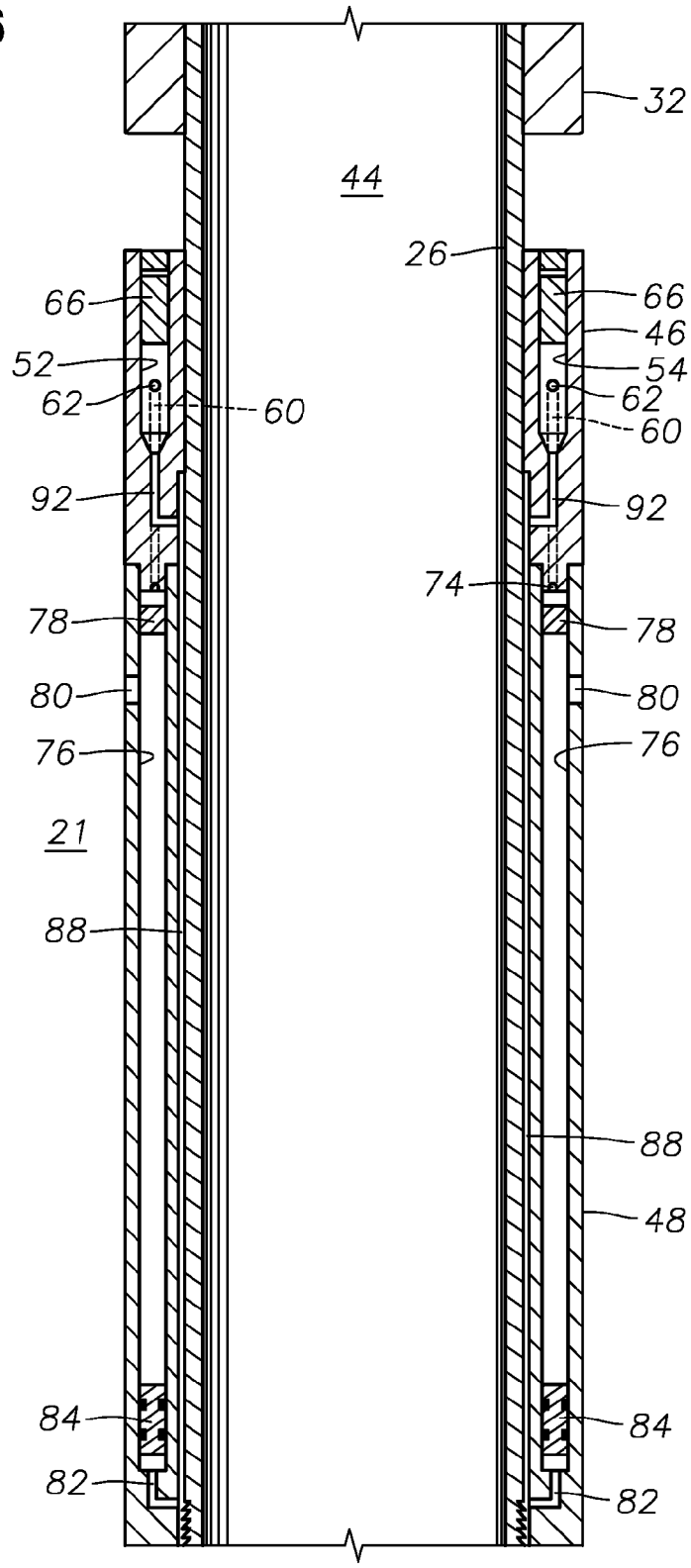
FIG. 6 is an enlarged side cross-sectional view of upper portions of the packer setting assembly shown in FIGS. 1, 2, and 3, now in an actuated condition.
Figure 6A:
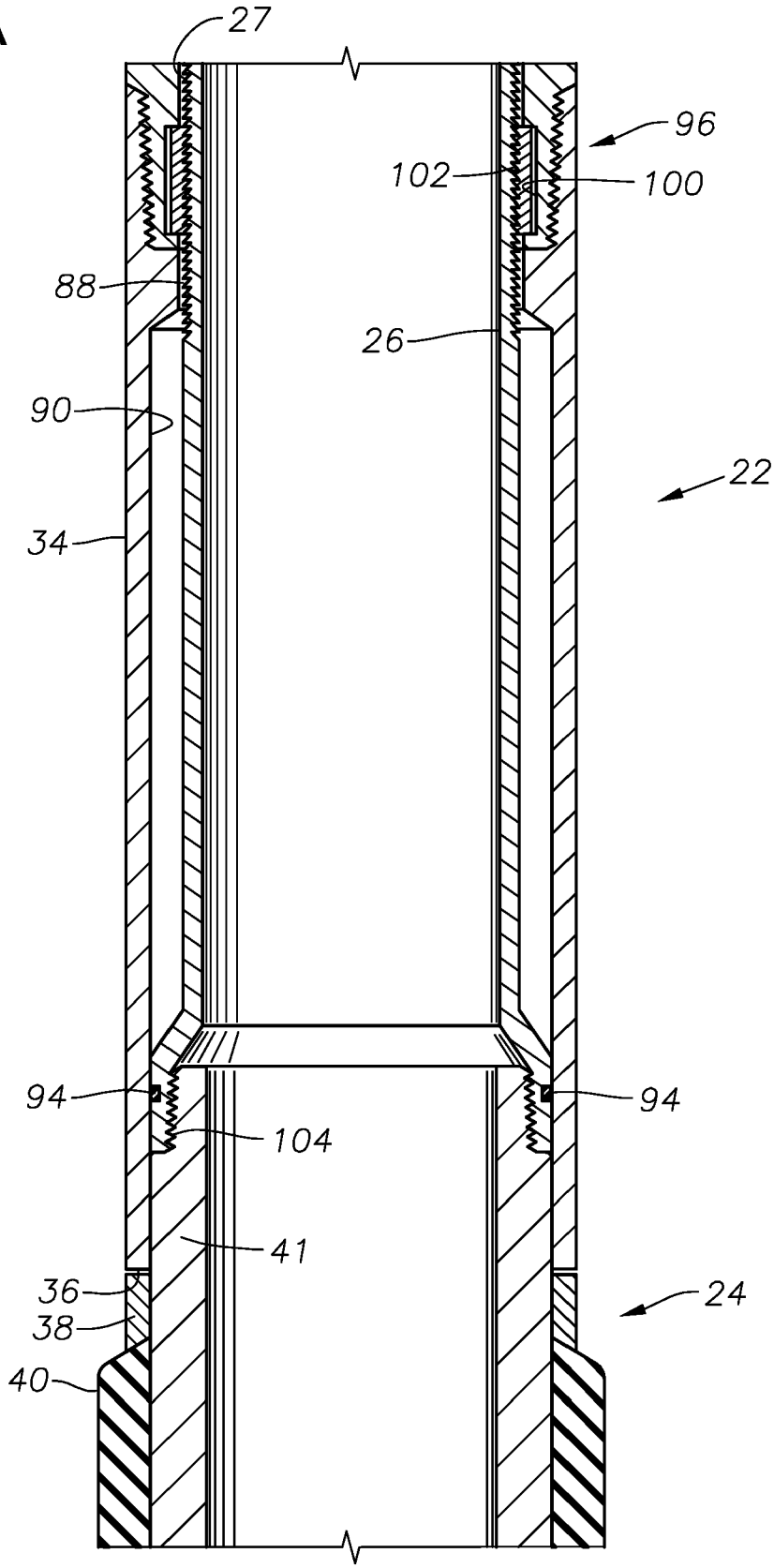
FIG. 6A is an enlarged side cross-sectional view of lower portions of the packer setting assembly shown in FIGS. 1, 2, and 3A, now in an actuated condition.

The packer setting device 22 is operated to set the packer 24 within the wellbore 10 in the following manner. In the instance in which the trigger devices 70 are rupture discs, fluid pressure is increased from the surface 20 within the annulus 21. The increase in annulus pressure will be communicated through openings 80 and into the piston chambers 76 of the packer setting device 22. The increased pressure within the piston chambers 76 will act upon the pistons 84 and urge them downwardly within the piston chambers, as depicted in FIG. 6. As the pistons 84 move downwardly, they increase the pressure of the hydraulic fluid that is enclosed within the fluid pathways 92 and annular chambers 88 and 90. Once the annulus pressure reaches a predetermined level that is sufficient to rupture the rupture discs 70, the enclosed hydraulic fluid will flow from the chamber 88 through fluid passages 92 and into the lower ends of both bores 52, 54. In so doing, the hydraulic fluid urges the flow plugs 66 upwardly within the bores 52, 54 to unblock the lateral passages 62 (see FIG. 6). Once the lateral passages 62 are unblocked, displaced hydraulic fluid can flow through those passages 62 to axial pathway 60 and into the annular channel 74. From the annular channel 74, the hydraulic fluid will enter the lower-pressure blind bores 86 and thereby compress the compressible fluid that is within each of the bores 86. As the hydraulic fluid enters the repository bores 86, it is drained from the annular chamber 90, and this draining action draws the setting sleeve 34 axially downwardly with respect to the interior mandrel 26 and the inner sub 41 of the affixed packer device 24. The escape of incompressible fluid from the chamber 90 creates a suction effect that essentially draws the shoulder 89 downwardly toward flange 93 and, as a result, setting sleeve 34 moves downwardly with respect to the interior mandrel 26. This suction force is further used as a setting force as the lower end 36 of the setting sleeve 34 contacts the compression ring 38 and urges it downwardly. The lower end 36 of the setting sleeve 34 contacts the compression setting ring 38 and urges it downwardly, thereby axially compressing and setting the packer element 40 of the packer device 24. The body lock ring assembly 96 ensures that this downward movement occurs in a ratchet-type one-way fashion. FIGS. 6 and 6A illustrate the set position of the setting device 22.

In an embodiment wherein the trigger devices 70 are electronically actuated valves, the setting process is essentially the same. However, in order to begin the setting process, there is no need to pressurize the annulus 21. Instead, the trigger device valves 70 are actuated from the surface 20 to an open position which will allow the incompressible fluid below them to urge the flow plugs 66 upwardly within the bores 52, 54 to unblock the lateral passages 62. The incompressible fluid will then be urged into the blind bores 76 under the impetus of hydrostatic wellbore pressure.

It is noted that the hydraulic fluid that is enclosed within the chambers 88 and 90 must traverse a tortuous path made up of small flow area fluid passages 92, 62 and 60 as well as annular channel 74 before it enters the blind bores 86. The use of this tortuous, flow-restrictive path ensures that setting force is increased gradually within the setting device 22 and does not result in rapid or premature setting of the affixed packer 24.

The packer setting tool 22 can be considered to have a compressible fluid chamber which is made up of the plurality of blind bores 86, the annular channel 74 interconnecting the blind bores 86, the axial passages 60, lateral passages 62. Prior to run-in, the compressible fluid chamber is filled with a compressible fluid, such as air, and this compressible fluid chamber is separated from the incompressible fluid by the trigger devices 70. The incompressible fluid is initially stored within an incompressible fluid storage volume that is made up, in this described embodiment, of the chambers 88 and 90 as well as the fluid passages 82, and 92 and the portion of the piston chambers 76 below the pistons 84. Upon actuation of the trigger devices 70, the incompressible fluid is released from the storage area and allowed to flood the compressible fluid chamber.

Figure 8:
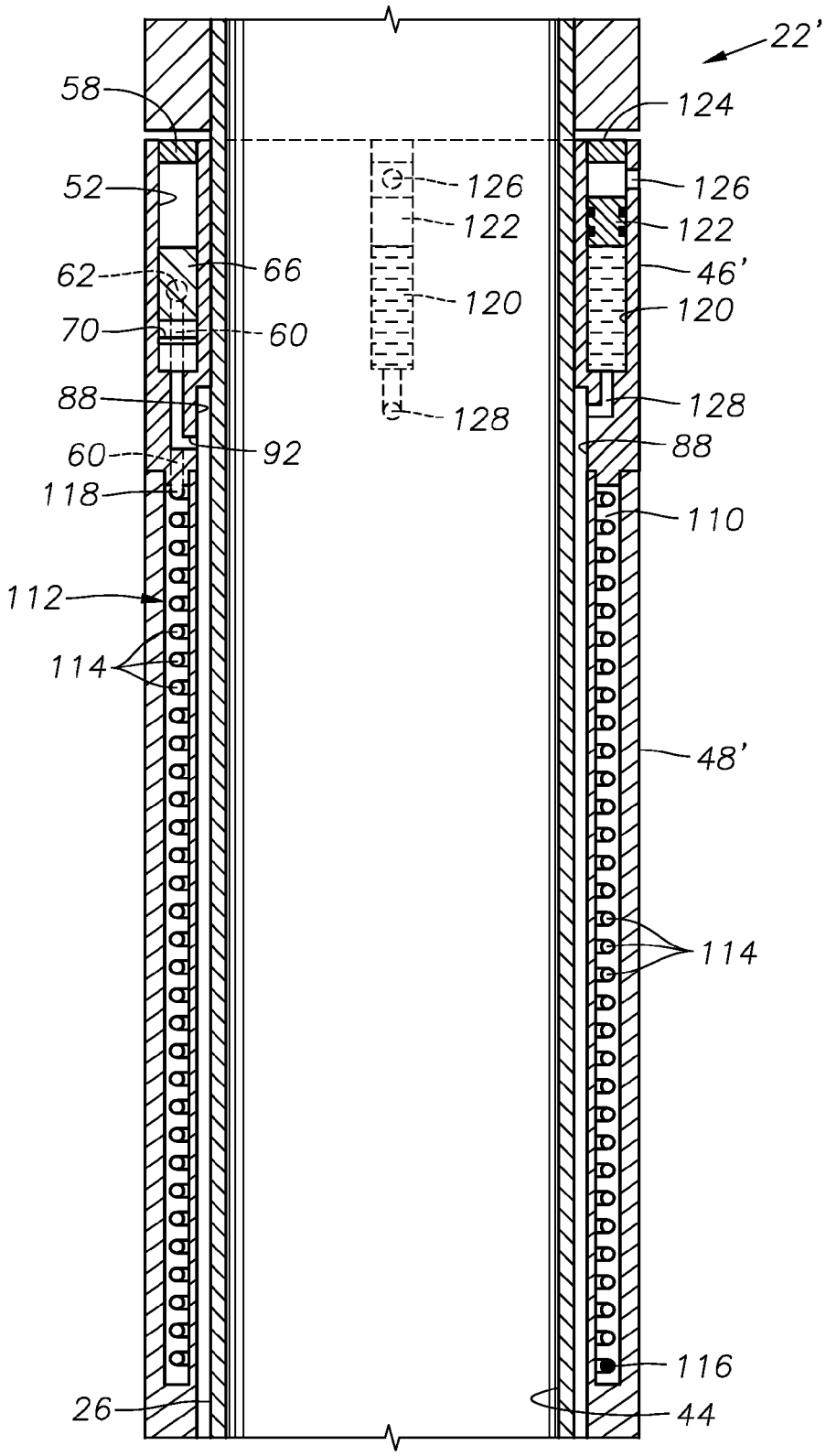
FIG. 8 is a side, cross-sectional view of an alternative embodiment for a packer setting assembly in accordance with the present invention wherein the compressible fluid chamber is formed of a spiral-wrapped tube.

FIG. 8 depicts portions of an alternative packer setting tool 22'. The packer setting device 22' is constructed and operates in the same manner as the packer setting device 22 except as noted herein. FIG. 8 illustrates a modified upper housing 46' and lower housing 48'. As with the housing 46, the upper housing 46' includes an axial bore 52 that is closed with pipe plug 58. Fluid passageway 92 interconnects the lower end of the bore 52 with the chamber 88, and there is a flow plug 66 and trigger device 70 present within the bore 52. It is noted that, in this embodiment, there is preferably only a single axial bore 52. Bore 54 is not present.

The lower housing 48' defines an annular chamber 110 that contains a tube 112 that is wound in a helical fashion to create coils 114 within the chamber 110. The tube 112 has a closed lower end 116. The open end 118 of tube 112 is interconnected with the fluid passageway 60.

The upper housing 46' also defines within its annular body a plurality of piston chambers 120 (two are shown). The piston chambers 120 have a piston 122 moveably disposed therewithin. Pipe plug 124 blocks the upper axial end of each piston chamber 120 while a lateral fluid opening 126 permits fluid communication with the annulus 21. A fluid passageway 128 extends from the lower end of each piston chamber 120 to the annular chamber 88. A substantially incompressible fluid is contained within an incompressible fluid chamber that is formed of the portions of piston chambers 120 below the pistons 122, fluid passages 120, the annular chambers 88 and 90 as well as the fluid passageway 92 and the portion of bore 52 below the trigger device 70.

A compressible fluid chamber is formed by the helical tube 112 and fluid passageways 60 and 62. The helical tube 112 is filled with a compressible fluid prior to run-in. The compressible fluid is at a pressure that is lower than the substantially incompressible fluid will be when in the wellbore 10. The compressible fluid will preferably be at approximately atmospheric pressure when the compressible fluid chamber is filled at the surface 20. The substantially incompressible fluid is, during run-in and prior to setting, at a pressure that is greater than that of the compressible fluid within the tube 112 since the wellbore hydrostatic fluid is able to exert its ambient hydrostatic pressure upon the substantially incompressible fluid via the pistons 122.

In operation, the packer setting device 22' is actuated to set the packer 24 by actuating the trigger device 70, in a manner described previously. When the trigger device 70 is actuated, the substantially incompressible fluid is flowed, under the impetus of ambient wellbore hydrostatic pressure acting upon pistons 122, into the compressible fluid chamber to flood the compressible fluid chamber. The packer device 24 is then set by movement of the setting sleeve 34 relative to the interior mandrel 26, as described previously.

It is noted that in both packer setting devices 22 and 22', the compressible fluid chamber and the incompressible fluid chambers are defined outside of the interior mandrel 26, thereby allowing thru-tubing operations to be conducted through the flowbore 44 before, during and after packer setting.

Those of skill in the art will recognize that numerous modifications and changes may be made to the exemplary designs and embodiments described herein and that the invention is limited only by the claims that follow and any equivalents thereof.

What is claimed is:

1. A setting device for actuating a wellbore tool within a wellbore, the device comprising:

an interior mandrel defining a central flowbore;

a setting member for contacting an actuatable portion of a wellbore tool, the setting member being moveable between a first position, wherein the actuatable portion of the tool is actuated;

a compressible fluid chamber defined within the setting device radially outside of the interior mandrel and containing a compressible fluid, the compressible fluid chamber comprising a plurality of axial blind bores formed within a housing surrounding the interior mandrel;

an incompressible fluid chamber defined within the setting device radially outside of the interior mandrel and containing a substantially incompressible fluid at a higher pressure than the compressible fluid;

a trigger device to selectively flood the compressible fluid chamber with the substantially incompressible fluid; and wherein the setting member is moved from the first position to the second position upon flooding of the compressible fluid chamber with the incompressible fluid from the incompressible fluid chamber.

2. The setting device of claim 1 further comprising a body lock assembly operably associated with the selling member to ensure one-way movement of the setting member toward the second position.

3. The setting device of claim 1 wherein the trigger device comprises a frangible rupture disc.

4. The setting device of claim 1 wherein the trigger device comprises a valve.

5. The setting device of claim 1 wherein the incompressible fluid chamber includes:

a piston chamber that is open to an annulus of the wellbore, the annulus being filled with fluid under hydrostatic pressure;

a piston moveably disposed within the piston chamber and presenting first and second axial ends, the first axial end being exposed to the annulus fluid and the second axial end being exposed to the incompressible fluid.

6. The setting device of claim 1 wherein the wellbore tool comprises a packer.

7. The setting device of claim 1 wherein the compressible fluid chamber comprises a helically coiled tube.

8. A packer assembly for use within a wellbore, the assembly comprising:

a packer device that is moveable between an unset position and a set position;

a packer setting device associated with the packer device to move the packer device from the unset position to the set position, the packer setting device comprising:

a housing that is interconnected with the packer device;

a compressible fluid chamber comprising a helically coiled tube within the housing that is filled with a substantially compressible fluid;

an incompressible fluid chamber within the housing that is filled with a substantially incompressible fluid;

a trigger device to selectively flood the compressible fluid chamber with the substantially incompressible fluid; and a setting member that is selectively moveable between first and second positions to set the packer device, the setting member being moved from the first to the second position when the compressible fluid chamber is flooded with the substantially incompressible fluid.

9. The packer assembly of claim 8 wherein the compressible fluid chamber comprises a plurality of blind bores.

10. The packer assembly of claim 8 wherein the trigger device is actuated by increasing fluid pressure within a wellbore annulus surrounding the packer setting device.

11. The packer assembly device of claim 8 wherein the trigger device comprises a frangible rupture disc.

12. The packer assembly of claim 8 wherein the trigger device comprises a valve.

13. The packer assembly of claim 8 wherein the compressible fluid chamber is flooded with the substantially incompressible fluid under the impetus of wellbore hydrostatic pressure.

14. The packer assembly of claim 8 wherein the packer setting device further comprises a body lock assembly operably associated with the setting member to ensure one-way movement of the setting member toward the second position.

15. A method of actuating a well tool within a wellbore having an annulus, the method comprising the steps of:

operably associating a well tool actuator with a downhole well tool, the well tool actuator having a setting member with movement responsive to hydrostatic pressure;

flowing wellbore fluid from the annulus into the well tool actuator under hydrostatic pressure;

opening a tortuous, flow restrictive flow path within the well tool actuator;

flowing a substantially incompressible fluid into a compressible fluid chamber within the well tool actuator along the flow path under impetus of the wellbore fluid; and wherein flowing the substantially incompressible fluid into the compressible fluid chamber causes the setting member to move and actuate the down hole well tool.

16. The method of claim 15 wherein the step of causing the setting member to move further comprises draining the substantially incompressible fluid from a drain chamber within the well tool actuator to create a suction force within the drain chamber, the suction force causing the setting member to move.

17. The method of claim 15 wherein the step of opening a flow path comprises increasing fluid pressure within the annulus to rupture a frangible rupture member within the well tool actuator.

18. The method of claim 15 wherein the step of opening a flow path comprises actuating a valve within the well tool actuator to allow the substantially incompressible fluid to flow into the compressible fluid chamber.

19. The method of claim 15 wherein the step of flowing a substantially incompressible fluid into a compressible fluid chamber within the well tool actuator along the flow path under impetus of the wellbore fluid further comprises moving a piston within a piston chamber, the piston being in communication with both the wellbore fluid and the substantially incompressible fluid.

* * * * *

UNITED STATES PATENT AND TRADEMARK OFFICE

CERTIFICATE OF CORRECTION

PATENT NO. : 7,681,652 B2
APPLICATION NO. : 11/729675
DATED : March 23, 2010
INVENTOR(S) : Gaudette et al.

It is certified that error appears in the above-identified patent and that said Letters Patent is hereby corrected as shown below:

In col. 7, line 9, the word "selling" should be -- setting --.

Signed and Sealed this

Twenty-seventh Day of April, 2010

David J. Kappos

David J. Kappos
*Director of the United States Patent and Trademark Office*